US007525060B2

(12) United States Patent
Sano

(10) Patent No.: US 7,525,060 B2
(45) Date of Patent: Apr. 28, 2009

(54) MOVABLE CONTACT POINT

(75) Inventor: Yoshiro Sano, Okayama (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/182,357

(22) Filed: Jul. 30, 2008

(65) Prior Publication Data

US 2009/0032378 A1 Feb. 5, 2009

(30) Foreign Application Priority Data

Aug. 2, 2007 (JP) ..... 2007-201612

(51) Int. Cl.
*H01H 5/30* (2006.01)

(52) U.S. Cl. ..... 200/406; 200/516

(58) Field of Classification Search ..... 200/406, 200/516

See application file for complete search history.

(56) References Cited

U.S. PATENT DOCUMENTS 6,271,491 B1 * 8/2001 Ono et al. ..... 200/520
6,563,068 B2 * 5/2003 Yamagata et al. ..... 200/406
6,683,265 B2 * 1/2004 Masuda ..... 200/406
6,855,900 B1 * 2/2005 Urushibata ..... 200/406
7,230,197 B2 * 6/2007 Sano et al. ..... 200/406
7,301,113 B2 * 11/2007 Nishimura et al. ..... 200/406

FOREIGN PATENT DOCUMENTS

JP 2004-139997 A 5/2004

* cited by examiner

*Primary Examiner*—Michael A Friedhofer
(74) *Attorney, Agent, or Firm*—Pearne & Gordon LLP

(57) ABSTRACT

A movable contact point according to the present invention includes a dome-shaped portion protruded upwardly at its center portion and at least three protrusions formed, on the dome-shaped portion, to protrude downwardly at positions which are evenly spaced apart from the center position of the dome-shaped portion, wherein the protrusions are formed to have a quadrangular-pyramid shape protruding downwardly and having a spherical-shaped apex portion.

2 Claims, 3 Drawing Sheets

MOVABLE CONTACT POINT

BACKGROUND OF THE INVENTION

1. Field of the Invention

The present invention relates to a movable contact point for use in forming a push-type switch usable in various types of electronic apparatuses, such as cellular phones.

2. Description of the Related Art

In recent years, there has been significantly advanced reduction of the sizes and the thicknesses of electronic apparatuses, such as movable communication apparatuses including cellular phones. Particularly, push-type switches having thin-shaped structures have been desirably used in the operation portions of such electronic apparatuses. Further, in forming such push-type switches, so-called movable contact point members structured to include movable contact points held on sheet members have been employed in many cases and, also, there has been a need for maintaining preferable touch feeling and long lives of such movable contact point members.

Hereinafter, there will be described a switch structured to include such a conventional movable contact point member, with reference to FIG. 7 and FIG. 8.

FIG. 7 is a cross-sectional view of a push-type switch structured to incorporate a conventional movable contact point member, and FIG. 8 is an exploded perspective view of the same.

In FIG. 7 and FIG. 8, movable contact point 1 is made of an elastic metal thin plate, is formed to have a circular-shaped contour and is protruded upwardly at its center portion in a dome shape. Further, sheet member 5 is made of a material such as PET which is provided with an adhesive agent, at its lower surface. Further, sheet member 5 is attached to spacer member 10 adjacent thereto.

Plural movable contact points 1 are placed within through holes 11 in spacer member 10 and are adhered and held, at their respective upper surfaces, to and on sheet member 5 through the adhesive agent on the lower surface of sheet member 5. Further, sheet member 5 is also adhered to the upper surface of spacer member 10 through the adhesive agent on its lower surface, and these members constitute movable contact member 15. Further, movable contact points 1 used herein have downwardly-protruding protrusions 3 having a small diameter and a semispherical shape which are formed with a pitch of 120 degrees at center position 7 in the dome-shaped portion.

Further, movable contact point member 15 is used in a state where movable contact point member 15 is placed on wiring board 25 which includes pairs of fixed contact points 20 and 21 placed at the positions corresponding to the positions at which respective movable contact points 1 are placed. Due to the state of the placement, a push-type switch with a thin-shaped structure illustrated in FIG. 7 is formed. Namely, in such a push-type switch, the lower surface of center position 7 including the lower end portions of protrusions 3 on movable contact points 1 is placed such that it is faced to fixed contact point 20 and, also, is spaced apart therefrom. Further, such a push-type switch is structured such that the lower end of the outer periphery of movable contact point 1 is placed on fixed contact point 21 with a ring shape.

Movable contact point member 15 is constituted by push-type switches arranged longitudinally and laterally in a matrix shape. In this case, if a pushing force is applied to a single push-type switch at the center portion of movable contact point 1 from above sheet member 5, the center portion will be operated to be inverted in moderation, thereby bringing the lower end portions of three protrusions 3 into contact with fixed contact point 20 at the corresponding position on wiring board 25. This realizes a switch-ON state where there is established conduction through movable contact point 1 between fixed contact point 20 and fixed contact point 21.

Further, if the pushing force is released, movable contact point 1 in the push-type switch will be restored to the original upwardly-protruding dome shape by its elastic restoring force, which will separate three protrusions 3 from center fixed contact point 20, thereby restoring the switch-OFF state illustrated in FIG. 7.

Further, there has been known Unexamined Japanese Patent Publication No. 2004-139997, as exemplary prior-art literature information relating to the invention according to the present application.

However, movable contact points 1 used in conventional movable contact point member 15 described above are adapted such that they come into contact with fixed contact points 20 at three protrusions 3 at three positions in operation and, also, these three protrusions 3 are each formed to have a semispherical shape protruding downwardly, thereby preferably offering excellent contact stability. On the other hand, in forming respective protrusions 3 on movable contact points 1, there is a need for performing processing with a punch which is formed to have a semispherical shape in its entirety and has a tip end with a small diameter which conforms to protrusions 3. Accordingly, in order to form movable contact points 1 using such a punch with a tip end with a small diameter, there is a need for replacing the punch with a higher frequency since the punch having the tip end with the small diameter has poor durability, which has induced the problem of reduction of the productivity in processing and producing movable contact points 1.

SUMMARY OF THE INVENTION

The present invention was made for overcoming the conventional problems and aims at providing a movable contact point capable of ensuring a stable contact state in operation and, also, improving the durability of a punch used in processing and forming the movable contact point for improving the productivity, thereby reducing the frequency of replacing the punch.

In order to attain the object, according to the present invention, there is provided a structure as follows.

A movable contact point according to the present invention is a movable contact point including a dome-shaped portion which is made of an elastic metal thin plate and protruded upwardly at its center portion, and further including at least three protrusions formed, on the dome-shaped portion, to protrude downwardly at positions which are evenly spaced apart from the center position of the dome-shaped portion, wherein the protrusions are formed to have a quadrangular-pyramid shape protruding downwardly and having a spherical-shaped apex portion. With the movable contact point according to the present invention, it is possible to ensure stable contact at three or more points in operation and, also, it is possible to employ a punch with a quadrangular-pyramid-shaped tip end portion for processing and forming the protrusions. This can cause the punch to have a larger thickness at its tip end portion, thereby improving the durability of the punch and reducing the replacing frequency. Furthermore, the joint portion between the dome-shaped portion and the protrusions on the movable contact point can be formed to have a moderate curved surface, thereby alleviating the concentration of stresses at the joint portion. Further, it is possible to ensure the height of the protrusions on the movable contact point more easily and stably than in cases of conventional semispherical-shaped protrusions, thereby ensuring a contact state with higher stability.

DETAILED DESCRIPTION OF THE PREFERRED EMBODIMENT

Figure 1:
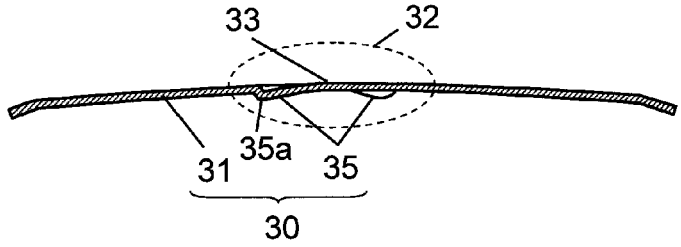
FIG. 1 is a cross-sectional view of a movable contact point according to a first embodiment of the present invention.

Hereinafter, an embodiment of the present invention will be described, with reference to FIGS. 1 to 6. In the following drawings, the dimensions of respective structures are enlarged, for ease of illustration of the structures. Further, identical components will be designated by the same reference characters and, therefore, will not be described in some cases.

First Embodiment

Figure 2:
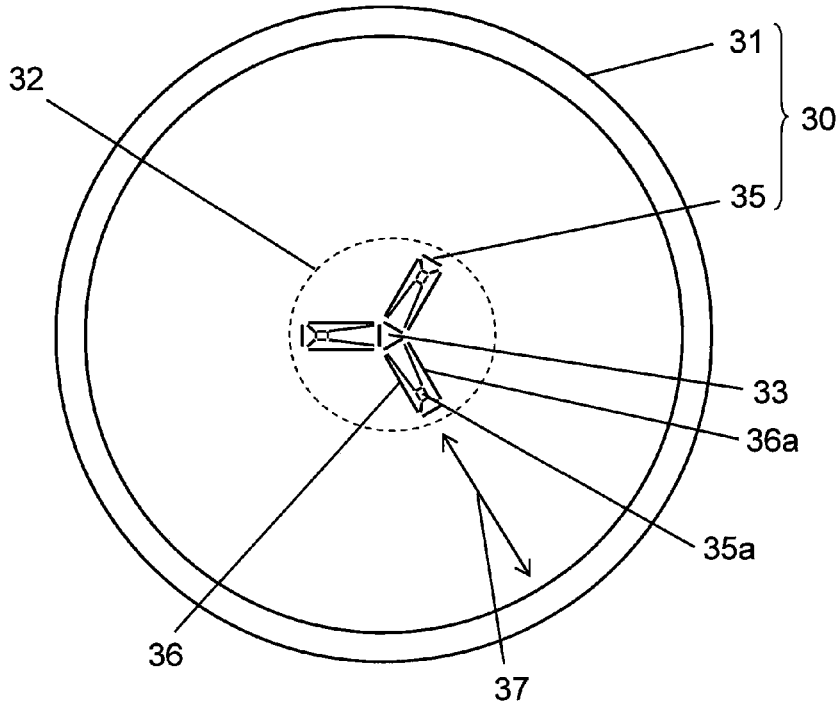
FIG. 2 is a bottom view of the movable contact point according to the first embodiment of the present invention.
Figure 3:
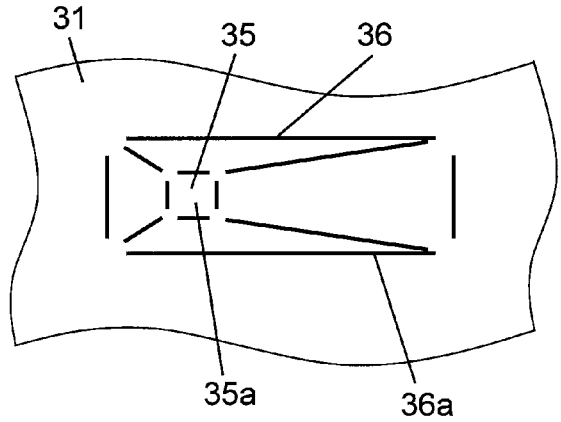
FIG. 3 is an enlarged plan view illustrating a protrusion which is a main part of the movable contact point, at the lower surface of the protrusion.
Figure 4:
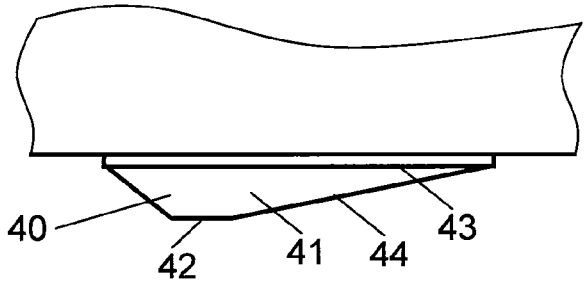
FIG. 4 is a side view of a punch for use in forming the movable contact point according to the first embodiment of the present invention.
Figure 5:
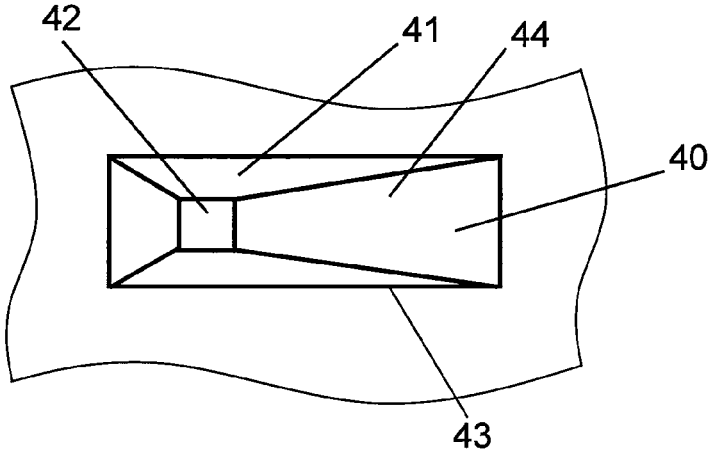
FIG. 5 is a bottom view of the punch for use in forming the movable contact point according to the first embodiment of the present invention.

FIG. 1 is a cross-sectional view of a movable contact point according to the first embodiment of the present invention. FIG. 2 is a bottom view of the same movable contact point. FIG. 3 is an enlarged plan view illustrating a protrusion which is a main part of the same movable contact point, at the lower surface of the protrusion. FIG. 4 is a side view of a punch for use in forming the same movable contact point. FIG. 5 is a bottom view of the same punch.

In FIG. 1 and FIG. 2, movable contact point 30 is made of an elastic thin-plate metal and has dome-shaped portion 31 formed to have a dome-shaped contour which has a circular shape when viewed at its upper and lower surfaces and protrudes upwardly at its center portion. Further, at center position 32 of dome-shaped portion 31, there are formed downwardly-protruding protrusions 35 with a substantially-quadrangular-pyramid shape which are placed with a pitch of 120 degrees.

Three protrusions 35 are provided to have the same shape at positions evenly spaced apart from center position 33 of movable contact point 30, and bottom portions 36 having the quadrangular-pyramid shapes are formed to have a rectangular shape as illustrated in FIG. 2 and FIG. 3. Furthermore, longitudinal directions 36*a* having the rectangular shapes are provided in parallel to radial directions 37 of movable contact point 30. Further, the positions of apex portions 35*a* having the quadrangular-pyramid shapes are set to be positions deviated outwardly in radial directions 37 within the positional ranges in which their quadrangular-pyramid shapes are placed. Furthermore, apex portions 35*a* are formed to have a continuous spherical shape.

In FIG. 4 and FIG. 5, punch 40 for use in forming protrusions 35 is formed to have tip end portion 41 with a quadrangular-pyramid shape which conforms the shape of protrusions 35 and, further, has apex portion 42 shaped to have a flat surface parallel to bottom surface 43. Further, its quadrangular-pyramid shape has inclined surface 44 formed to be a flat surface, which enables formation of tip end portion 41 of punch 40 with higher accuracy and, also, facilitates to set the position of apex portion 42 at a position deviated from the center of the quadrangular-pyramid shape.

By deviating apex portion 42 as described above, it is possible to cause tip end portion 41 of punch 40 to have a larger thickness at its lower portion than those of punches for use in forming semispherical protrusions which have been conventionally formed in many cases. This can improve the durability of punch 40, which reduces the replacing frequency and increases the productivity. Further, since apex portion 42 on tip end portion 41 of punch 40 is provided with a flat surface, apex portions 35*a* of protrusions 35 on movable contact point 30 are naturally processed to have a continuous spherical shape.

Further, movable contact point 30 can be formed to have a moderate curved surface at the joint portion between dome-shaped portion 31 and protrusions 35, thereby alleviating the concentration of stresses at the joint portion. Furthermore, it is possible to ensure the height of the protrusions on movable contact point 30 more easily and stably than in cases of conventional semispherical-shaped protrusions, thereby ensuring a contact state with higher stability.

Thus processed movable contact point 30 can be used for forming various types of push-type switches. For example, although not illustrated, it is possible to employ an aspect where movable contact point 30 is housed within a switch case such that movable contact point 30 can be pushed through an operation member for causing switching, or an aspect where dome-shaped portion 31 of movable contact portion 30 is held on sheet member 5 as in a convention manner.

Hereinafter, there will be briefly described an embodiment where dome-shaped portion 31 of movable contact point 30 is held on sheet member 5, with reference to a cross-sectional view of FIG. 6. Further, in FIG. 6 and in the following description, the same components as those of the conventional structure will be designated by the same reference characters and will not be described in detail.

Figure 6:
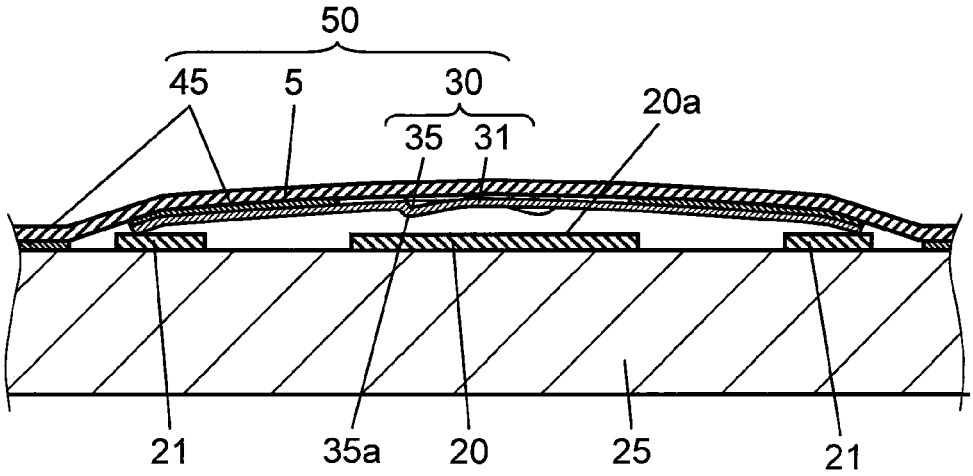
FIG. 6 is a cross-sectional view of a push-type switch structured to incorporate a movable contact point member employing a movable contact point according to the first embodiment of the present invention.
Figure 7:
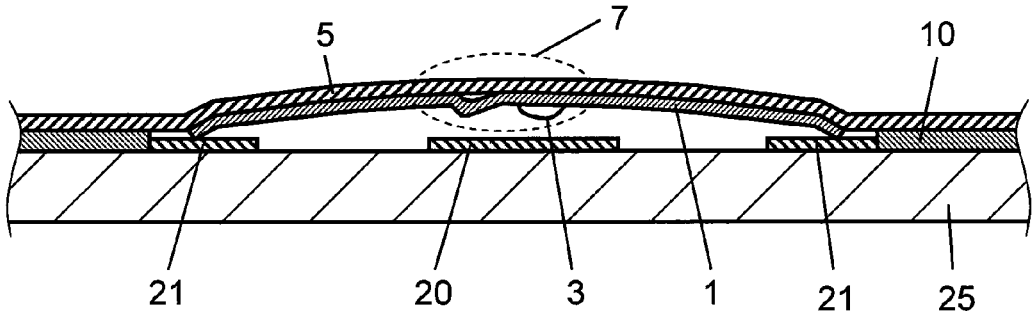
FIG. 7 is a cross-sectional view of a push-type switch structured to incorporate a conventional movable contact point member.
Figure 8:
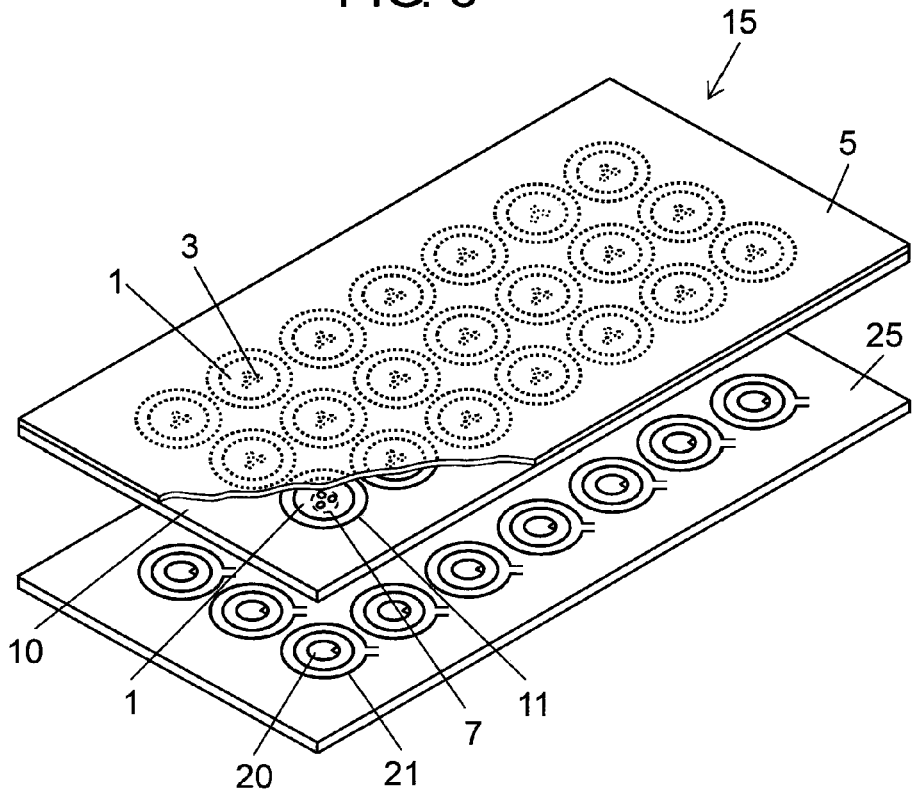
FIG. 8 is an exploded perspective view of a push-type switch structured to incorporate a conventional movable contact point member.

As illustrated in FIG. 6, movable contact point 30 is adhered and held, at its upper surface, to and on sheet member 5, through adhesive agent 45 patterned on the lower surface of sheet member 5 in such a way as to avoid the positions at which protrusions 35 are placed. Further, movable contact point 30 according to the present first embodiment is formed from only the aforementioned members, as movable contact point member 50.

Further, movable contact point member 50 is placed on wiring board 25 including fixed contact points 20 and 21 which are adaptable to movable contact point member 50, and adhesive agent 45 on the lower surface of sheet member 5 at the portion surrounding movable contact point 30 is adhered to wiring board 25, thereby forming a push-type switch having a thin-shaped structure.

The switch is operated as follows. That is, if the center portion of movable contact point 30 is pushed from above sheet member 5, the center portion will be operated to be inverted, thereby bringing three protrusions 35 into contact with fixed contact point 20 opposing to the center portion, at three positions. This will realize a switch-ON state where there is established conduction, through movable contact point 30, between fixed contact point 20 at the center and fixed contact points 21 on which the lower end of the outer periphery of movable contact point 30 is laid. On the other hand, if the pushing force is released, movable contact point 30 will be restored to the original shape by itself, thereby being restored to the switch-OFF state illustrated in FIG. 6.

As described above, if the center portion of movable contact point 30 according to the present first embodiment is operated to be inverted, this will bring apex portions 35*a* of protrusions 35 which have a spherical shape, as in the conventional structure, into contact with corresponding fixed contact point 20 at three positions. Accordingly, movable contact point 30 according to the present embodiment has excellent contact stability.

In this case, in movable contact point 30 according to the present first embodiment, respective protrusions 35 are formed to have a substantially-quadrangular-pyramid shape which protrudes downwardly, as described above. With this structure, respective protrusions 35 are formed over larger formation areas than those of conventional semispherical-shaped protrusions, which enables easily and stably ensuring the required height of protrusions 35. Furthermore, the joint portion between protrusions 35 and dome-shaped portion 31 at the periphery of protrusions 35 can be formed to have a moderate curved surface, thereby alleviating the concentration of stresses at this portion. In these respects, movable contact point 30 according to the present first embodiment is more advantageous than conventional structures.

Further, the positions of apex portions 35*a* of protrusions 35 are set to be positions deviated outwardly in radial directions 37 from center position 33 of dome-shaped portion 31, within the positional ranges in which their quadrangular-pyramid shapes are placed. This can cause inclined surface 44 at the center portion of the quadrangular-pyramid shape to form a smaller angle with respect to surface 20*a* of fixed contact point 20. This can increase the degree of flexibility of deformation at the center portion of movable contact point 30, thereby offering the advantage of preferable touch feeling in operation.

Further, as described above, the number of protrusions 35 is preferably three as in the example described in the present first embodiment, but the number of the protrusions 35 can be more than three. Further, the contour of movable contact point 30 is not limited to a circular shape, and can be, for example, an oval shape.

Further, the shape of the bottom portion having the quadrangular-pyramid shape is not limited to a rectangular shape, and can be a quadrangle shape.

With the movable contact point according to the present invention, it is possible to offer the advantages that a stable contact state can be ensured in operation and that the durability of the punch for use in formation and processing can be improved, thereby enabling fabrication with higher productivity. Further, the movable contact point according to the present invention can form a main part of a push-type switch for use in various types of electronic apparatuses. Accordingly, the movable contact point according to the present invention is usable.

What is claimed is:

1. A movable contact point comprising:

a dome-shaped portion which is made of an elastic metal thin plate and protruded upwardly at its center portion;

at least three protrusions formed, on the dome-shaped portion, to protrude downwardly at positions which are evenly spaced apart from a center position of the dome-shaped portion, wherein the protrusions are formed to have a quadrangular-pyramid shape protruding downwardly and having a spherical-shaped apex portion.

2. The movable contact point according to claim 1, wherein the protrusions with the quadrangular-pyramid shape have a bottom portion having a rectangular shape, the longitudinal directions of the rectangular shapes are parallel to radial directions of the dome-shaped portion, and the positions of the apex portions of the protrusions are set to positions deviated outwardly from the center position of the dome-shaped portion, along the radial directions, within the positional ranges in which their quadrangular-pyramid shapes are placed.

* * * * *